US012478823B2

(12) United States Patent
Sorin et al.

(10) Patent No.: US 12,478,823 B2
(45) **Date of Patent: *Nov. 25, 2025**

(54) ATTACHMENT APPARATUSES FOR SQUAT EXERCISES AND METHODS OF USING SAME

(71) Applicants: Richard Sorin, Lexington, SC (US); Albert Sorin, Lexington, SC (US)

(72) Inventors: Richard Sorin, Lexington, SC (US); Albert Sorin, Lexington, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/216,826

(22) Filed: Jun. 30, 2023

(65) Prior Publication Data

US 2023/0338768 A1 Oct. 26, 2023

Related U.S. Application Data

(63) Continuation of application No. 17/238,475, filed on Apr. 23, 2021, now Pat. No. 11,724,147.

(51) Int. Cl.

| | |
|---|---|
| ***A63B 21/00*** | (2006.01) |
| ***A63B 21/06*** | (2006.01) |
| ***A63B 21/072*** | (2006.01) |
| ***A63B 21/08*** | (2006.01) |

(52) U.S. Cl.
CPC ..... *A63B 21/159* (2013.01); *A63B 21/0615* (2013.01); *A63B 21/4047* (2015.10); *A63B 21/0728* (2013.01); *A63B 21/08* (2013.01)

(58) Field of Classification Search
CPC ..... A63B 21/0615; A63B 21/00072; A63B 21/159; A63B 21/4033; A63B 21/4047; A63B 21/0728; A63B 21/08; A63B 21/0442; A63B 21/4001; A63B 21/4009; A63B 21/04; A63B 21/0405; A63B 23/0405; A63B 2023/0411; A63B 2210/50; A63B 2244/09
See application file for complete search history.

(56) References Cited

U.S. PATENT DOCUMENTS

| | | | | |
|---|---|---|---|---|
| 3,850,430 A * | 11/1974 | Hamilton | A63B 21/0615 482/97 |
| 4,266,766 A | 5/1981 | Calderone | |
| 4,323,236 A * | 4/1982 | Szabo | A63B 21/4035 482/97 |
| 4,336,934 A * | 6/1982 | Hanagan | A63B 21/159 482/73 |
| 4,344,619 A * | 8/1982 | Szabo | A63B 21/0615 248/161 |

(Continued)

FOREIGN PATENT DOCUMENTS

| | | |
|---|---|---|
| CN | 202620601 U | 12/2012 |
| KR | 20180036164 A | 4/2018 |
| WO | 2011128058 A1 | 10/2011 |

*Primary Examiner* — Loan B Jimenez
*Assistant Examiner* — Kathleen M Fisk
(74) *Attorney, Agent, or Firm* — Todd A. Serbin; Maynard Nexsen PC

(57) ABSTRACT

An exercise apparatus for attachment to an exercise rack or upright, comprising: a lever arm attached at a first end to the exercise rack; at least one mounting prong connected to the lever arm, wherein the at least one mounting prong is upturned; and, an attachment point located at a second end of the lever arm, opposite the first end, configured to connect the apparatus to a user.

17 Claims, 11 Drawing Sheets

(56) References Cited

U.S. PATENT DOCUMENTS

| | | | | |
|---|---|---|---|---|
| 4,856,775 | A | 8/1989 | Colledge et al. | |
| 4,923,195 | A * | 5/1990 | Calderone | A63B 23/1281 482/97 |
| 5,194,060 | A * | 3/1993 | Marchetti | A63B 21/4047 482/133 |
| 5,207,624 | A * | 5/1993 | Paskovich | A63B 21/072 482/109 |
| 5,310,393 | A * | 5/1994 | Highsmith | A63B 21/0615 482/148 |
| 5,484,365 | A | 1/1996 | Jones et al. | |
| 5,628,715 | A | 5/1997 | Simonson | |
| 6,685,601 | B1 | 2/2004 | Knapp | |
| 7,918,771 | B2 * | 4/2011 | Rogers | A63B 21/4035 482/100 |
| 8,657,726 | B2 * | 2/2014 | Rogers | A63B 21/4047 482/100 |
| 8,734,305 | B1 | 5/2014 | Hoole | |
| 8,936,537 | B2 * | 1/2015 | Hoole | A63B 23/03525 482/137 |
| 9,498,676 | B1 | 11/2016 | Emick | |
| 9,808,663 | B2 * | 11/2017 | Chen | A63B 21/4049 |
| 9,827,460 | B2 * | 11/2017 | Staten | A63B 21/062 |
| 10,343,008 | B2 | 7/2019 | Pullins et al. | |
| 11,013,945 | B2 | 5/2021 | Sorin et al. | |
| 2004/0176223 | A1 | 9/2004 | Morris et al. | |
| 2005/0148445 | A1 | 7/2005 | Carle | |
| 2005/0187078 | A1 | 8/2005 | Carter | |
| 2006/0160678 | A1 * | 7/2006 | Franklin | A63B 21/4047 482/92 |
| 2007/0287606 | A1 | 12/2007 | Mac Millan | |
| 2008/0085821 | A1 | 4/2008 | Webb | |
| 2011/0190104 | A1 | 8/2011 | Derrick | |
| 2011/0306466 | A1 * | 12/2011 | Mullen | A63B 69/16 482/61 |
| 2012/0238418 | A1 | 9/2012 | Reyes | |
| 2017/0087400 | A1 | 3/2017 | Chen | |
| 2017/0203149 | A1 * | 7/2017 | D'Amico | A63B 21/0615 |
| 2018/0104526 | A1 | 4/2018 | Kelly | |
| 2018/0311522 | A1 * | 11/2018 | Schmidt | A63B 21/4009 |

* cited by examiner

ATTACHMENT APPARATUSES FOR SQUAT EXERCISES AND METHODS OF USING SAME

RELATED APPLICATIONS

This application claims the benefit of priority under 35 U.S.C. § 120 of U.S. patent application Ser. No. 17/238,475, filed on Apr. 23, 2021, which claimed priority under 35 U.S.C. § 119(e) of U.S. Provisional Patent Application No. 62/735,014 filed Sep. 21, 2018 and under 35 U.S.C. § 120 of U.S. patent application Ser. No. 16/577,102 filed Sep. 20, 2019 (now issued as U.S. Pat. No. 11,013,945), the contents of which are incorporated herein by reference in their entireties.

FIELD AND BACKGROUND OF THE INVENTION

The present invention, in some embodiments thereof, relates to the exercise industry and, more particularly, but not exclusively, to a manually operated exercise apparatus.

SUMMARY OF THE INVENTION

According to an aspect of some embodiments of the present invention there is provided an exercise apparatus for attachment to an exercise rack or upright, comprising: a lever arm attached at a first end to the exercise rack; at least one mounting prong connected to the lever arm, wherein the at least one mounting prong is upturned; and, an attachment point located at a second end of the lever arm, opposite the first end, configured to connect the apparatus to a user.

In an embodiment of the invention, the attachment point comprises at least one of a hole, an angled bar, a straight bar, and two different parts extending towards each other which have a small gap between them.

In an embodiment of the invention, the at least one mounting prong is vertical.

In an embodiment of the invention, the apparatus further comprises a connector including a pin disposed at the first end of the lever arm for attaching the lever arm to the exercise rack and defining an axis of rotation of the exercise apparatus.

In an embodiment of the invention, the apparatus further comprises a stand comprising a pivot point, wherein the pivot point defines a pivot axis substantially transverse to a longitudinal axis of the arm.

In an embodiment of the invention, the stand is configured in a first, vertical configuration when the apparatus is at rest and a second, largely horizontal configuration when the apparatus is in motion.

In an embodiment of the invention, the stand is rotatable with respect to the arm about the pivot axis to transition the stand from the first configuration to the second configuration.

In an embodiment of the invention, the stand includes a handle.

In an embodiment of the invention, the stand is counterbalanced to provide automatic rotation about the pivot axis.

In an embodiment of the invention, the stand further comprises protective pads located at the bottom of the stand and wherein the protective pads optionally are weighted to influence the pivoting performance of the stand.

In an embodiment of the invention, the apparatus further comprises a main body sized and shaped to mount on the arm and wherein at least one of the mounting prong and the stand are connected to or forms a part of the main body.

In an embodiment of the invention, the main body has at least one aperture sized and shaped for insertion of a locking pin therethrough, to reversibly secure the main body to the arm.

In an embodiment of the invention, the at least one mounting prong is sized and configured for the placement of weight plates thereon.

According to an aspect of some embodiments of the present invention there is further provided a method of exercising using an exercise attachment attached to an exercise rack or upright, comprising: attaching, to the exercise rack, the exercise apparatus, comprising a lever arm attached at a first end to the exercise rack, at least one mounting prong connected to the lever arm, wherein the at least one mounting prong is upturned, and, an attachment point located at a second end of the lever arm, opposite the first end, configured to connect the apparatus to a user; placing at least one weight on the at least one mounting prong; connecting the exercise apparatus to the user using the attachment point.

In an embodiment of the invention, the method further comprises lifting the exercise apparatus from the second end around an axis of rotation of the first end to commence exercise.

In an embodiment of the invention, the attaching is accomplished by inserting a pin through a connector disposed at the first end of the lever arm and the exercise rack, the pin defining an axis of rotation of the exercise apparatus.

In an embodiment of the invention, the attachment point comprises at least one of a hole, an angled bar, a straight bar, and two different parts extending towards each other which have a small gap between them, for connecting the user to the exercise apparatus.

In an embodiment of the invention, exercise further comprises returning the exercise apparatus to an original starting position and repeating the lifting and the returning.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
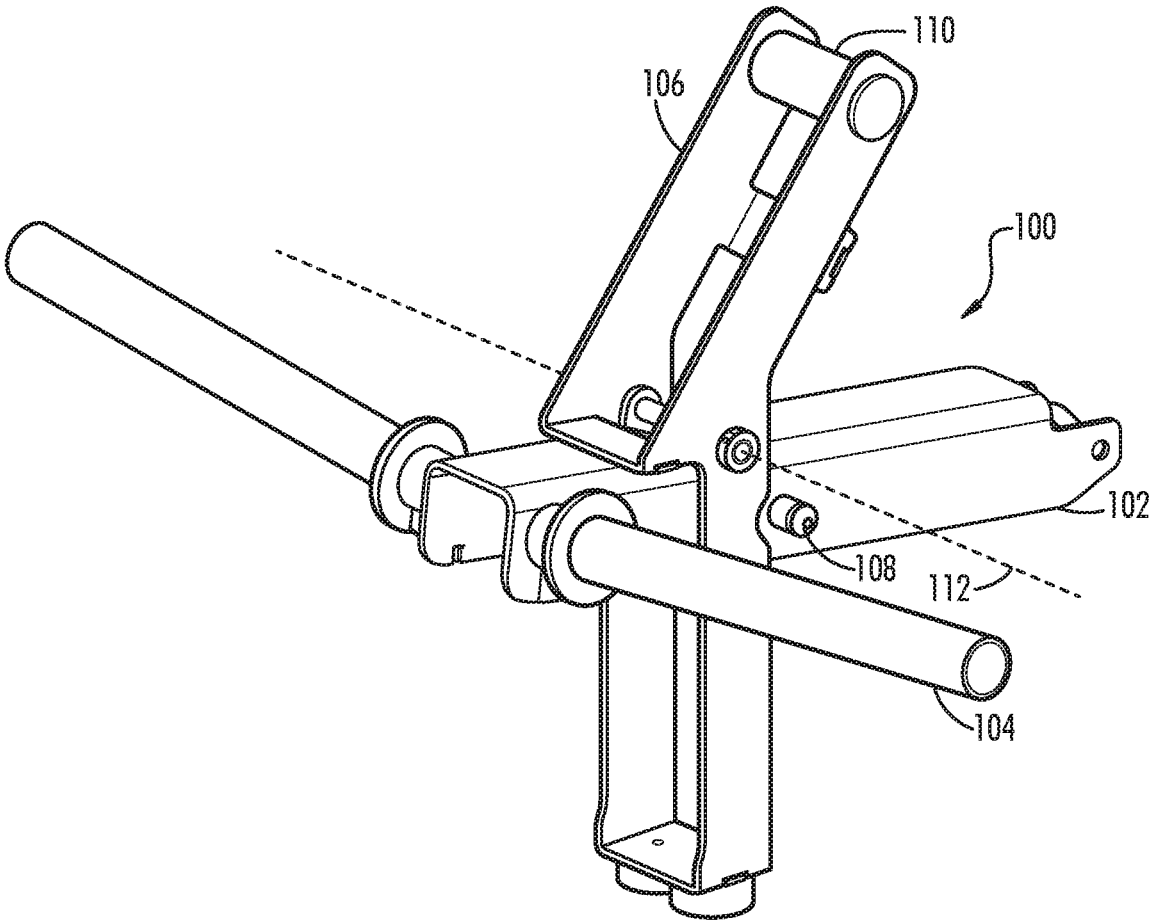
FIG. 1 is a perspective view of an attachment apparatus for squat exercise.

The present invention, in some embodiments thereof, relates to the exercise industry and, more particularly, but not exclusively, to a manually operated exercise apparatus.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Figure 7:
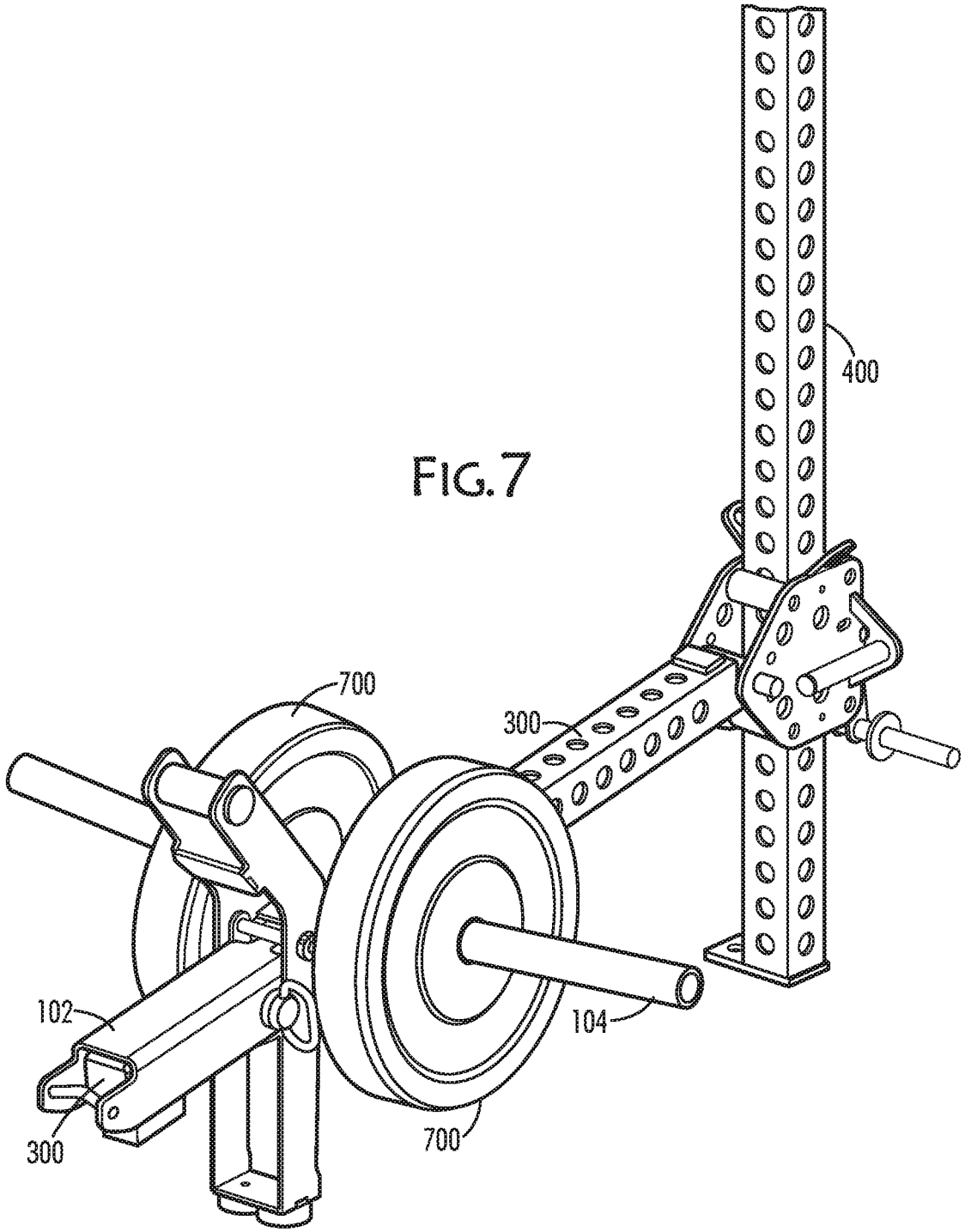
FIG. 7 is a perspective view of an attachment apparatus for squat exercise of FIG. 1 with weights, installed on a jammer arm attached to a weight rack.

Referring now to the drawings, FIG. 1 is a perspective view of an attachment apparatus 100 for squat exercise, in accordance with an exemplary embodiment of the invention. The attachment apparatus 100 comprises at least one of a main body 102, at least one mounting prong 104 and a stand 106, in an embodiment of the invention. In an embodiment of the invention, the main body 102 is sized and shaped to mate with a Sorinex® Jammer Arm™ and/or a conventional weight rack (e.g. a Sorinex® Base Camp™ rack). In an embodiment of the invention, the mounting prong 104 is used to place weights, for example weight plates such as shown in FIG. 7, for performing resistance based exercises with the apparatus 100. In some embodiments a pivoting stand 106 is used to maintain the apparatus 100 off the ground, and/or a lever 300, described in more detail in FIG. 3 (lever 300, also referred to herein as a lever arm or Jammer Arm™).

The attachment apparatus 100 is optionally a steel add-on component, that with the use of a connector, for example at least one locking pin 108 or bolt, will convert a regular or adjustable "Jammer" pivoting arm 300 to a squat-enabled exercise apparatus. The at least one locking pin 108 is inserted into a hole 302 in the lever arm 300, in some embodiments. In some embodiments of the invention, the apparatus 100 comprises at least one mounting prong 104 and/or the stand 106. Optionally, the at least one mounting prong 104 and/or the stand 106 connects directly to the arm 300, or a lever-like structure, for example using pins, connectors, clips, or the like and/or being securely inserted directly into holes 302 in the lever arm 300 itself. Optionally, at least one of the apparatus components, such as at least one prong 104 and/or the stand 106 are formed/manufactured as a unitary part of the lever arm 300. In some embodiments using the apparatus 100, there is no need for a separate or integrated "deck" usually made of steel, rubber, aluminum or wood. The athlete stands and performs the lifts directly on the ground, although can add step for additional range of motion.

Figure 8:
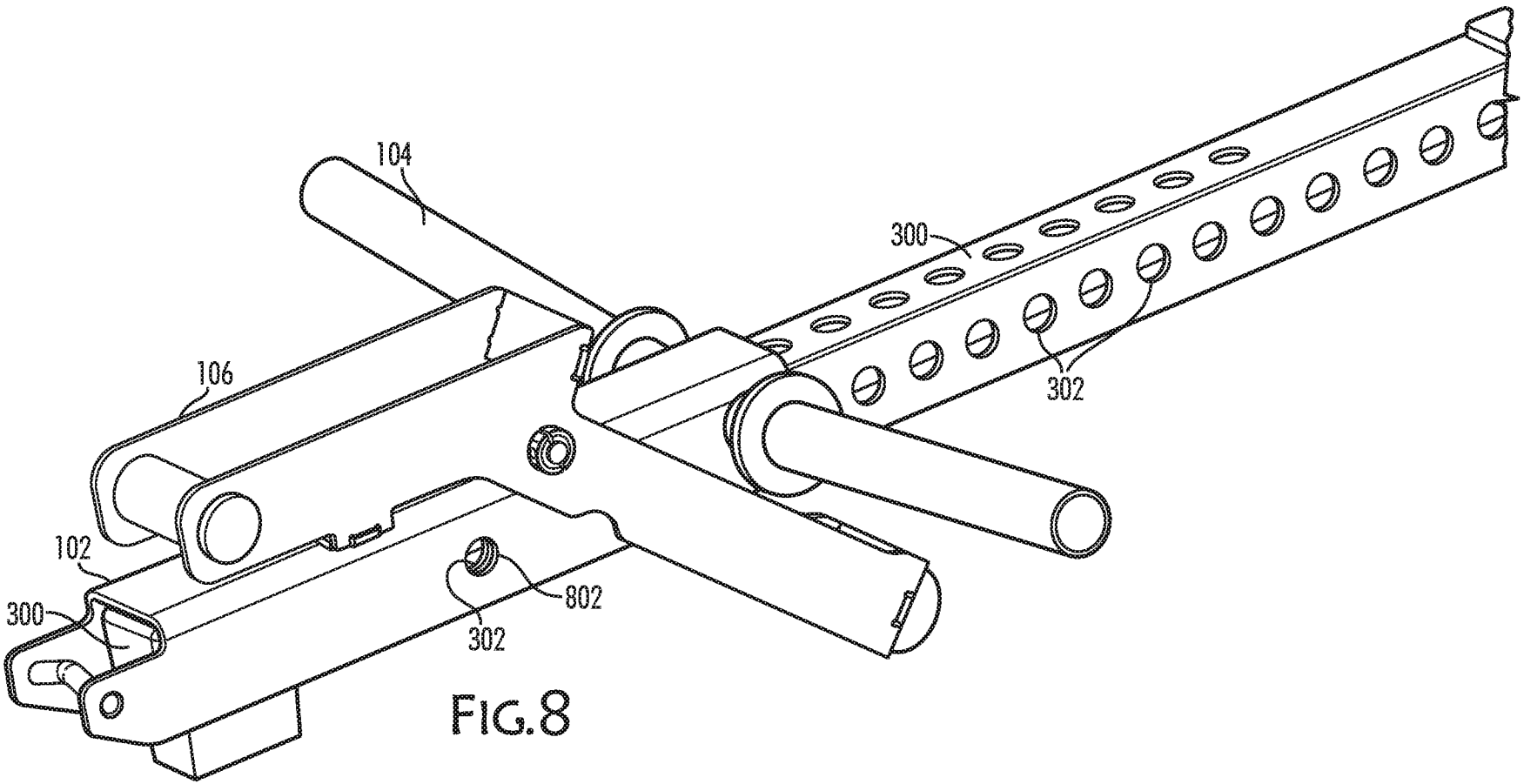
FIG. 8 is a perspective view of an attachment apparatus for squat exercise of FIG. 1 with the stand in a rotated configuration.
Figure 9:
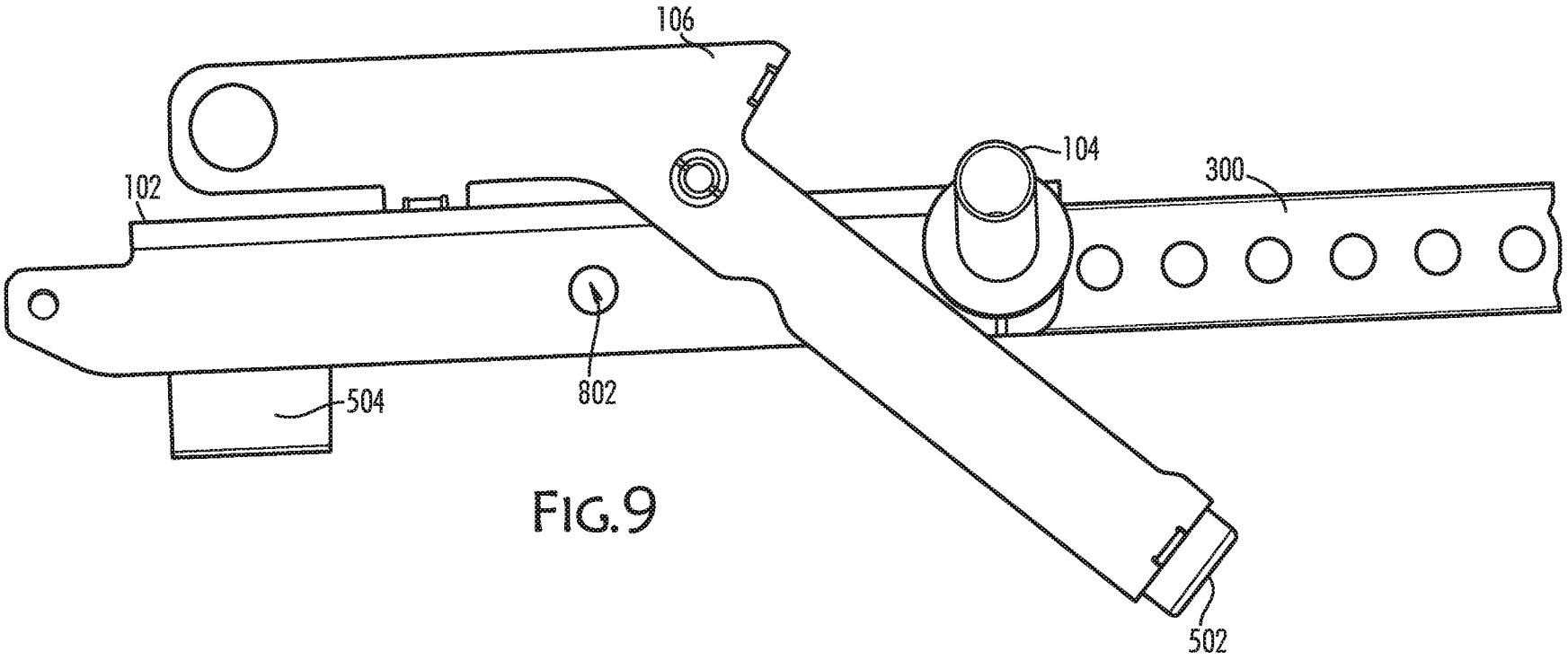
FIG. 9 is a side view of an attachment apparatus for squat exercise of FIG. 1 with the stand in a rotated configuration.

The apparatus 100 encompasses at least a single mounting prong 104, optionally upturned to reduce possibility of weights 700 falling off during use. It also has an attachment point 404 (shown in more detail in FIG. 4) for a hook, carabiner, handle or strap system to connect the Jammer arm 300 to the athlete using the apparatus 100. As described elsewhere herein, the stand 106 is optionally counterbalanced to fall out of a vertical configuration and into a largely horizontal configuration such as shown in FIGS. 8 and 9) when the apparatus 100 is in use, to allow for full range of motion. In an embodiment of the invention, the stand is reengaged manually, for example by the athlete grabbing a stand handle 110 optionally located at or near the top of the stand 106 (although the handle 110 or handles could conceivably be located anywhere the user could conveniently grasp it during exercise), to an original starting position, which reduces range of motion required to initiate and conclude the exercise, which increases safety and convenience Jammer Arm 300 can be positioned to adjust the pivot point of the entire apparatus 100. Optionally, the kick stand 106 is not counterbalanced and is manually operated into the horizontal configuration and/or back into the vertical configuration.

It is believed that some of the advantages of the apparatus 100 over conventional solutions in this industry include: a smaller footprint; no deck to step up on, trip on, or be limited by; less expensive; multiple use (re-purposing of Jammer Arms 300 for additional exercises); and, can be easily stored when not in use (e.g. can remove apparatus 100 or components of apparatus, such as weight prongs 104, from the Jammer Arm 300 and placed in storage).

Figure 2:
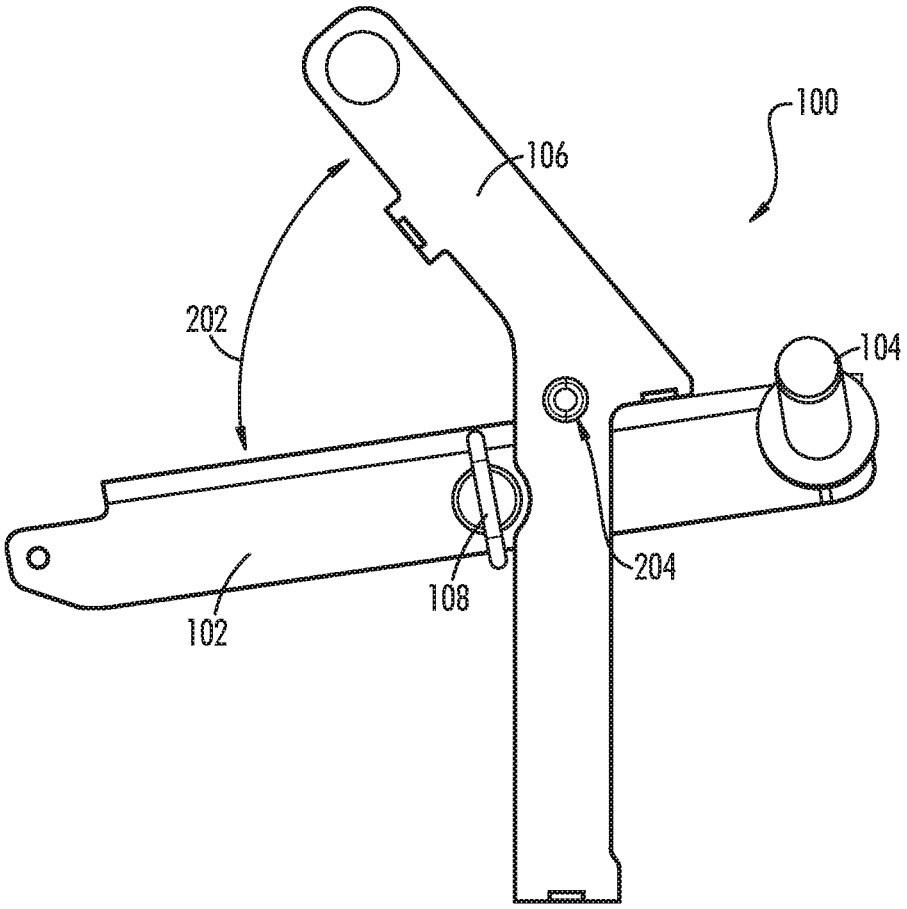
FIG. 2 is a side view of an attachment apparatus for squat exercise of FIG. 1.

FIG. 2 is a side view of an attachment apparatus 100 for squat exercise of FIG. 1. Shown here also, is an exemplary range of movement 202, either manually or by the counterbalancing, of the stand 106 around a pivot point 204 when the apparatus 100 is used during exercise and lifted off the ground. That is, the rotating pivot point 204 defines a pivot axis 112 (shown in FIG. 1) substantially transverse to a longitudinal axis of the lever arm and wherein the stand 106 is rotatable with respect to the lever arm 300 about the pivot axis.

Figure 3:
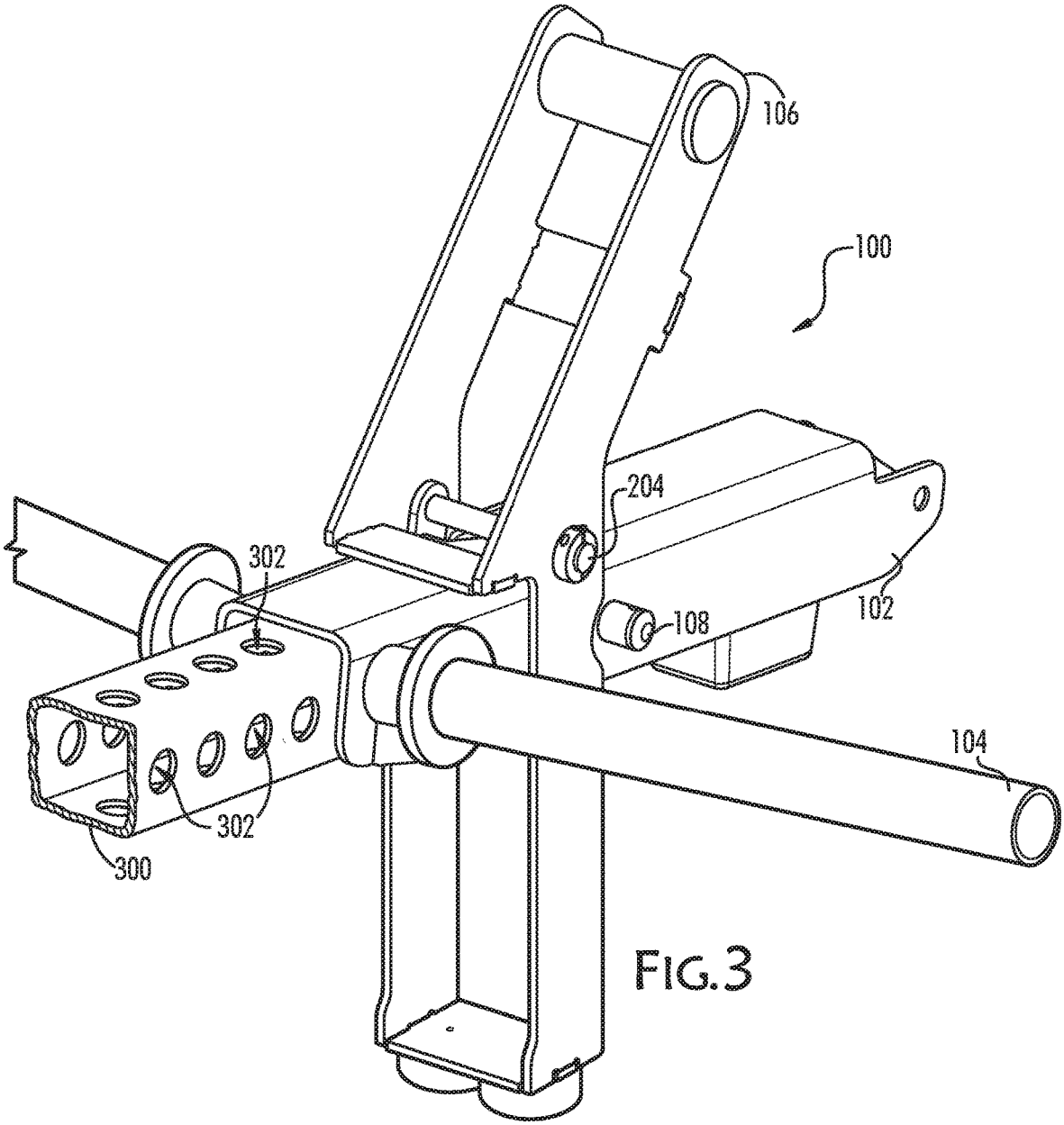
FIG. 3 is a perspective view of an attachment apparatus for squat exercise of FIG. 1 installed on a jammer arm.

FIG. 3 is a perspective view of an attachment apparatus 100 for squat exercise of FIG. 1 installed on a lever arm 300 with attachment holes 302, in accordance with an exemplary embodiment of the invention.

Figure 4:
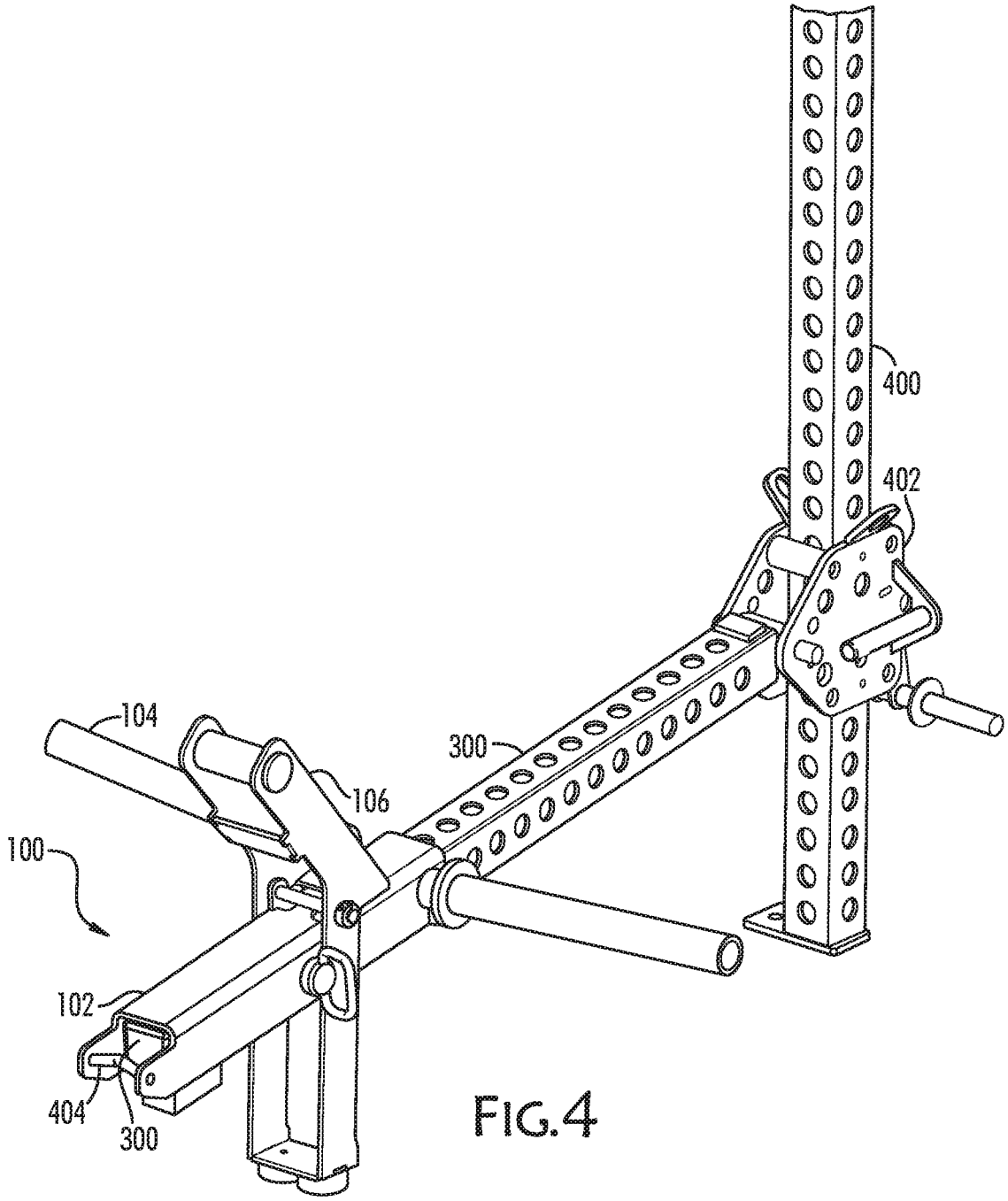
FIG. 4 is a perspective view of an attachment apparatus for squat exercise of FIG. 1, installed on a jammer arm attached to a weight rack.

FIG. 4 is a perspective view of an attachment apparatus 100 for squat exercise of FIG. 1, installed on a Jammer Arm (lever arm) 300 attached to a weight rack 400, such as a Sorinex® Base Camp™ rack, optionally using an adjustable rack mount 402, such as the Sorinex® Adjustable Rack Attachment Point™ available at the URL www.sorinex.com/products/jammer-arms. Also shown in FIG. 4 is an attachment point 404 where a user can clip or attach to the apparatus 100 for commencing exercise. While the attachment point 404 is shown as an angled bar, it should be understood the bar could be straight, it doesn't have to fully traverse the gap (e.g. it could be two different parts extending towards each other which have a small gap between them), it could just be a hole or holes, or any other structural configuration which could act as a counterpart to an attachment mechanism between the user and the apparatus 100.

Figure 5:
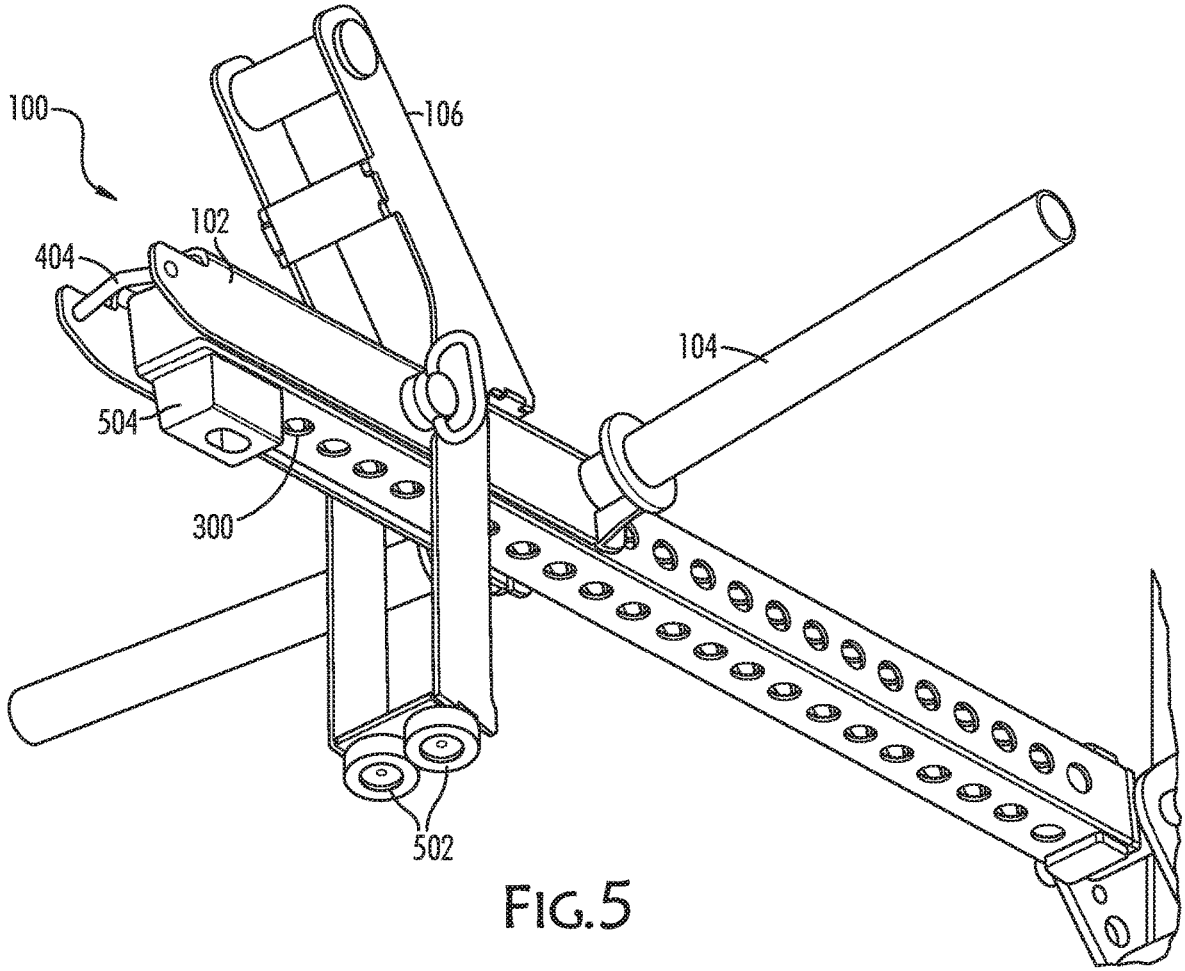
FIG. 5 is an underside perspective view of an attachment apparatus for squat exercise of FIG. 1 installed on a jammer arm.

FIG. 5 is an underside perspective view of an attachment apparatus 100 for squat exercise of FIG. 1 installed on a Jammer Arm 300, while also showing optional protective pads 502 for the stand 106, for when the stand 106 hits the ground. In some embodiments, the protective pads 502 can also function as balancing weights (e.g. by using heavier or lighter pads 502) for at least partially controlling the counterbalancing action of the stand 106. Also shown is an optional bumper 504 for serving as a buffer between the floor and the apparatus 100 during exercise, to protect both from impact during use (in case the apparatus 100 hits the floor).

Figure 6:
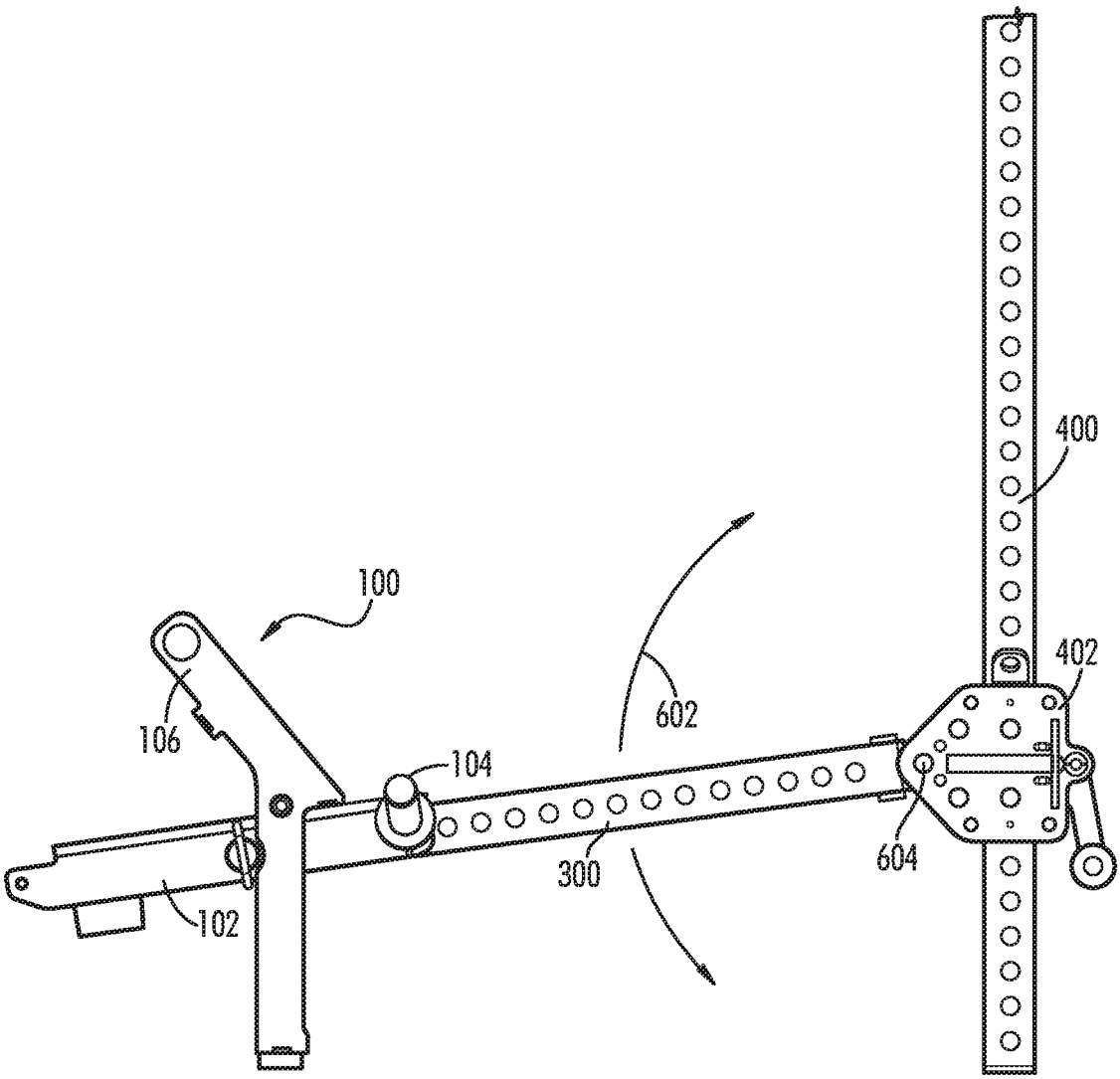
FIG. 6 is a side view of an attachment apparatus for squat exercise of FIG. 1, installed on a jammer arm attached to a weight rack.

FIG. 6 is a side view of an attachment apparatus 100 for squat exercise of FIG. 1, installed on a Jammer Arm 300 attached to a weight rack 400, in accordance with an exemplary embodiment of the invention. In an embodiment of the invention, exercise with the apparatus 100 is performed by a user moving the lever arm 300 up and down in direction 602 around the pivot point 604 created by the mount 402. It should be understood that in some embodiments of the invention, the stand 106 is in the horizontal configuration during exercise movement (such as shown in FIGS. 8 and 9).

FIG. 7 is a perspective view of an attachment apparatus 100 for squat exercise of FIG. 1 with weights 700, installed on a Jammer Arm 300 attached to a weight rack 400, in accordance with an exemplary embodiment of the invention.

FIG. 8 is a perspective view of an attachment apparatus 100 for squat exercise of FIG. 1 with the stand 106 in a rotated configuration, in accordance with an exemplary embodiment of the invention. Also shown is a hole 302 of the lever arm 300 aligned with an aperture 802 in the apparatus 100, through which the pin 108 is inserted (when the hole 302 and the aperture 802 are aligned) to reversibly secure the apparatus 100 to the lever arm 300. In some embodiments of the invention, there may be an additional, alternative and/or optional aperture on the other side of the apparatus 100, or even on the top or bottom of the apparatus 100.

FIG. 9 is a side view of an attachment apparatus 100 for squat exercise of FIG. 1 with the stand in a rotated configuration, in accordance with an exemplary embodiment of the invention.

Figure 10:
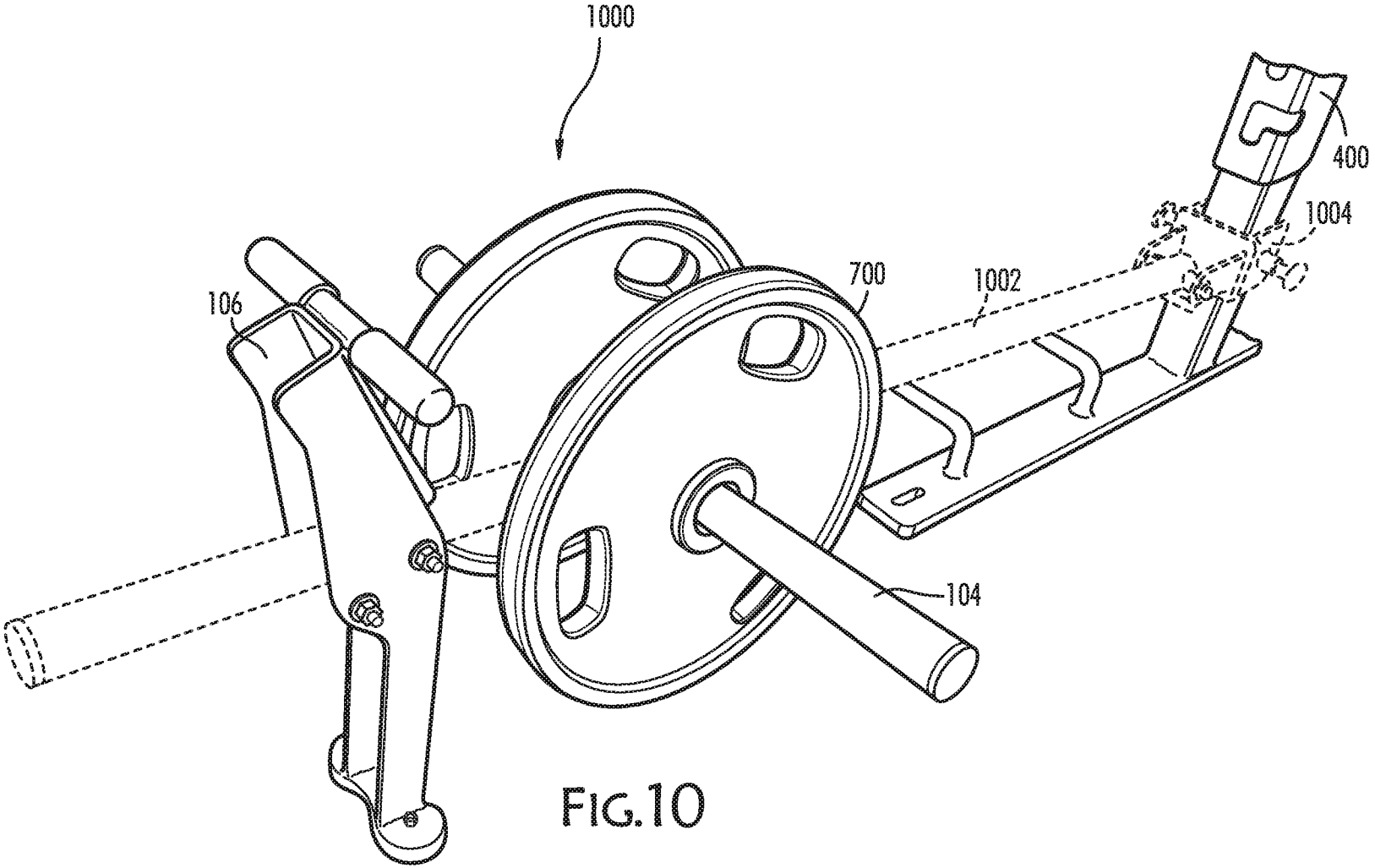
FIG. 10 is a schematic view of the rotating stand in use with weights and a generic lever arm; and, FIG. 11 is a flowchart of a method of using the attachment apparatus for squat exercise of FIG. 1.

FIG. 10 is a schematic view of an embodiment of the apparatus 1000 including an embodiment of the rotating stand 106 in use with weights 700 and a generic lever arm 1002. It should be understood that the apparatus does not have to include a main body, such as shown in FIG. 1 and may optionally, comprise some components of the apparatus such as the stand 106 and/or at least one weight prong 104, but not others. Further, as described above, apparatus 100 does not have be used with a lever arm 300 with the specific configuration shown in FIGS. 4-9 and could be used with any arm and/or generic mount/connector 1004.

Figure 11:
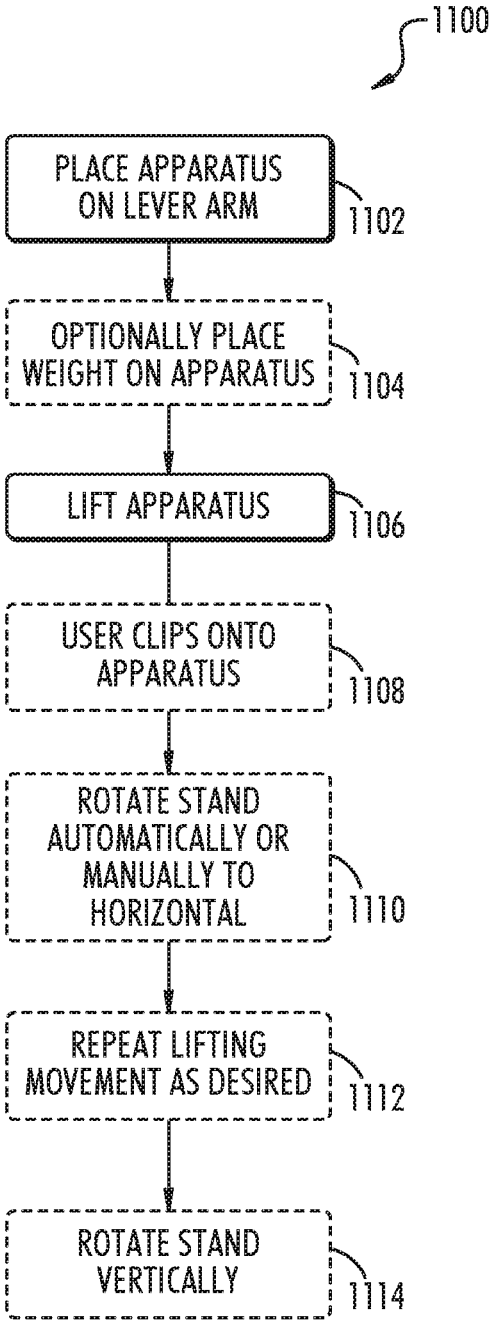

FIG. 11 is a flowchart 1100 of a method of using the attachment apparatus 100, 1000 for squat exercises. In an embodiment of the invention, the apparatus 100, 1000 is placed (1102) on a lever arm 300, 1002 such that the lever arm is pivotably/rotatably attached to the rack 400 with respect to the rack. For example, using mount 402 as the connection. Depending on the user's desire for exercise difficulty, the user may optionally place (1104) at least one weight 700 on at least one weight prong 104 of the apparatus 100, 1000.

While the user of the apparatus could conceivably just grab the apparatus (for example, using the weight prongs 104 as handles), in some embodiments of the invention, the user clips (1106) onto the apparatus 100, or otherwise reversibly connects to the attachment 100, using the attachment point 404, thereby connecting the apparatus to the user, for example where the user is wearing a belt with a clip that clips onto the attachment point 404. In an embodiment of the invention, the apparatus 100 is located low on the rack 400, such that when the user connects himself to the apparatus, the user is in a squatting bodily position. It should be understood, however, that the mount 402 enables the positioning of the lever arm 300, and therefore the apparatus 100, at almost any vertical position with respect to the user. The user then commences exercise, for example by standing up from the squatting position and lifting (1108) the apparatus in an upwards direction (in relation to the floor). As described elsewhere herein, the stand 106 is counterbalanced such that when the user stands up and lifts the apparatus 100, 1000 sufficiently so that the stand 106 is no longer abutting the floor, the stand 106 rotates (1110) from the substantially vertical positon shown in FIG. 2, inter alia, to the substantially horizontal position shown in FIGS. 8 and 9. Optionally, the user manually rotates the stand to the horizontal position. Optionally, exercise can be performed without the stand 106 rotating (remaining substantially vertical), for example if the mount 402 is moved higher on the rack 400. In an embodiment of the invention, the user continues (1112) exercise, optionally repeating the standing up and squatting down movements (i.e. known as "squats") until the user is satisfied with the amount of exercise performed. In some embodiments of the invention, the user then rotates (1114) the stand 106 from the substantially horizontal position back to the substantially vertical position to allow the lever arm 300 and apparatus 100, 1000 to be supported by the floor through the stand 106.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An exercise apparatus for attachment to an exercise rack or upright, comprising:

a lever arm attached at a first end to the exercise rack;

at least one mounting prong connected to the lever arm;

a stand, connected to or forming a part of the lever arm and extending below the lever arm, comprising a pivot point, wherein the stand is configured to automatically transition from a first, vertical configuration when the apparatus is at rest to a second, largely horizontal configuration when the apparatus is in motion; and, an attachment point located at a second end of the lever arm, opposite the first end, configured to attach the apparatus to a user.

2. The exercise apparatus according to claim 1, wherein the stand is configured to manually transition from the second, largely horizontal configuration when the apparatus is in motion to the first, vertical configuration using a handle.

3. The exercise apparatus according to claim 2, wherein the stand is rotatable with respect to the lever arm about the pivot axis to transition the stand from the first configuration to the second configuration.

4. The exercise apparatus according to claim 1, further comprising a main body sized and shaped to mount on the lever arm and wherein at least one of the at least one mounting prong and the stand are connected to or forms a part of the main body.

5. The exercise apparatus according to claim 4, wherein the main body has at least one aperture sized and shaped for insertion of a locking pin therethrough, to reversibly secure the main body to the lever arm.

6. The exercise apparatus according to claim 1, wherein the attachment point comprises at least one of a hole, an angled bar, a straight bar, and two different parts extending towards each other which have a small gap between them.

7. The exercise apparatus according to claim 1, further comprising a connector including a pin disposed at the first end of the lever arm for attaching the lever arm to the exercise rack and defining an axis of rotation of the exercise apparatus.

8. The exercise apparatus according to claim 1, wherein the pivot point defines a pivot axis substantially transverse to a longitudinal axis of the lever arm.

9. The exercise apparatus according to claim 1, wherein the stand includes a handle.

10. The exercise apparatus according to claim 1, wherein the stand is counterbalanced to provide automatic rotation about the pivot axis.

11. The exercise apparatus according to claim 1, wherein the stand further comprises protective pads located at the bottom of the stand and wherein the protective pads optionally are weighted to influence the pivoting performance of the stand.

12. The exercise apparatus according to claim 1, wherein the at least one mounting prong is sized and configured for the placement of weight plates thereon.

13. A method of exercising using an exercise attachment attached to an exercise rack or upright, comprising:

attaching, to the exercise rack or upright, an exercise apparatus, comprising a lever arm attached at a first end to the exercise rack, at least one mounting prong connected to the lever arm, a stand, connected to or forming a part of the lever arm and extending below the lever arm, comprising a pivot point, wherein the stand is configured to automatically transition from a first, vertical configuration when the apparatus is at rest to a second, largely horizontal configuration when the apparatus is in motion; and, an attachment point located at a second end of the lever arm, opposite the first end, configured to attach the exercise apparatus to a user;

placing at least one weight on the at least one mounting prong;

attaching the exercise apparatus to the user using the attachment point; and, lifting the exercise apparatus from the second end around an axis of rotation of the first end to commence exercise and to automatically transition the stand from the first, vertical configuration to the second, largely horizontal configuration.

14. The method according to claim 13, wherein the attaching to the exercise rack is accomplished by inserting a pin through a connector disposed at the first end of the lever arm and the exercise rack, the pin defining the axis of rotation of the first end of the exercise apparatus.

15. The method according to claim 13, wherein the attachment point comprises at least one of a hole, an angled bar, a straight bar, and two different parts extending towards each other which have a small gap between them, for attaching the user to the exercise apparatus.

16. The method according to claim 13, wherein the exercising further comprises returning the exercise apparatus to an original starting position and repeating the lifting and the returning.

17. The method according to claim 13, further comprising manually transitioning the stand from the second, largely horizontal configuration to the first, vertical configuration upon the termination of the exercising.

* * * * *